US010811756B2

(12) United States Patent
Li et al.

(10) Patent No.: US 10,811,756 B2
(45) Date of Patent: Oct. 20, 2020

(54) METHOD TO DESIGN AND ASSEMBLE A CONNECTOR FOR THE TRANSITION BETWEEN A COAXIAL CABLE AND A MICROSTRIP LINE

(71) Applicant: NATIONAL TAIPEI UNIVERSITY OF TECHNOLOGY, Taipei (TW)

(72) Inventors: Eric S. Li, Taipei (TW); Hung-Yi Wu, Taipei (TW); Wen-Shuo Tsai, Taipei (TW)

(73) Assignee: NATIONAL TAIPEI UNIVERSITY OF TECHNOLOGY, Taipei (TW)

( * ) Notice: Subject to any disclaimer, the term of this patent is extended or adjusted under 35 U.S.C. 154(b) by 571 days.

(21) Appl. No.: 15/591,140

(22) Filed: May 10, 2017

(65) Prior Publication Data

US 2017/0352937 A1 Dec. 7, 2017

(30) Foreign Application Priority Data

Jun. 7, 2016 (TW) ..... 105117925 A

(51) Int. Cl.
*H01P 11/00* (2006.01)
*H01P 5/08* (2006.01)

(52) U.S. Cl.
CPC ..... *H01P 11/001* (2013.01); *H01P 5/085* (2013.01)

(58) Field of Classification Search
CPC .. H01P 5/085; H01P 5/22; H01P 5/227; H01P 11/001; H01P 11/003; H01P 11/005; H01R 24/44
See application file for complete search history.

(56) References Cited

U.S. PATENT DOCUMENTS 4,280,112 A * 7/1981 Eisenhart ..... H01P 5/085 333/21 R
4,995,815 A * 2/1991 Buchanan ..... H01R 9/0515 439/63
5,215,477 A * 6/1993 Weber ..... H01R 24/52 439/581
5,886,590 A * 3/1999 Quan ..... H01P 5/085 333/260
6,663,424 B1 * 12/2003 Wyse ..... H01P 5/085 333/260
7,295,084 B2 * 11/2007 Tanbakuchi ..... H01P 1/047 333/260
8,152,534 B1 * 4/2012 Li ..... H01R 9/0515 439/63
2006/0284699 A1 * 12/2006 Weiske ..... H01P 5/085 333/33

(Continued)

*Primary Examiner* — Peter Dungba Vo
*Assistant Examiner* — Jeffrey T Carley
(74) *Attorney, Agent, or Firm* — Bacon & Thomas, PLLC

(57) ABSTRACT

A method to design and assemble a connector for the transition between a coaxial cable and a microstrip line involves in connecting a coaxial connector in series with a metallic ring to form a new coaxial connector, wherein the thickness of the metallic ring and the diameter of its through hole are important design parameters to determine the frequency response of the transition. By properly selecting their values and connecting the new coaxial connector to the microstrip line, a resonant response caused by the excitation of the first higher-order mode of the original coaxial connector is attenuated or eliminated from the frequency response.

8 Claims, 11 Drawing Sheets

(56) References Cited

U.S. PATENT DOCUMENTS

| | | | | |
|---|---|---|---|---|
| 2011/0241965 | A1* | 10/2011 | Wu | H01P 5/085 343/847 |
| 2012/0056696 | A1* | 3/2012 | Cheng | H01P 5/085 333/260 |
| 2014/0342581 | A1* | 11/2014 | Clyatt | H01R 24/44 439/63 |
| 2016/0192487 | A1* | 6/2016 | Zhou | H05K 1/0251 174/257 |

* cited by examiner

METHOD TO DESIGN AND ASSEMBLE A CONNECTOR FOR THE TRANSITION BETWEEN A COAXIAL CABLE AND A MICROSTRIP LINE

BACKGROUND OF THE INVENTION

(1) Field of the Invention

The present invention relates to a method to design and assemble a connector for the transition between a coaxial cable and a microstrip line, particularly for the one that features the attenuation or even elimination of a resonant response caused by the excitation of the first higher-order mode of the conventional coaxial connector from the frequency response of the transition.

(2) Description of the Prior Art

In the field of microwave communications, due to the requirements of device testing or system integration, transitions between two different transmission lines selected from coaxial cables, microstrip lines, waveguides, coplanar waveguides, and the like are always encountered in practical applications, wherein the transition between a coaxial cable and a microstrip line is the most popular one.

For ease of operation, a transition between a coaxial cable and a microstrip line is usually implemented by a coaxial connector immediately connected to the microstrip line, followed by the connection of a coaxial cable to the coaxial connector. Please refer to FIG. 1, which is a schematic view for a transition between a coaxial cable 10 and a microstrip line 200 through a conventional flange mount coaxial connector 100. The flange mount coaxial connector 100 comprises a center conductor 110, an external conductor 120 with a mounting wall 130, and a dielectric body 140 to fill up the space between the center conductor 110 and the external conductor 120. The microstrip line 200 comprises a signal line 210, a ground plane 220, and a substrate 230. The substrate 230 is placed on top of the ground plane 220, and the signal line 210 is disposed longitudinally on the upper surface of the substrate 230. With these configurations on the flange mount coaxial connector 100 and the microstrip line 200, the transition between the flange mount coaxial connector 100 and the microstrip line 200 is accomplished by connecting the center conductor 110 of the flange mount coaxial connector 100 to the signal line 210 of the microstrip line 200, as well as by connecting the external conductor 120 of the flange mount coaxial connector 100 to the ground plane 220 of the microstrip line 200. This type of transition between a flange mount coaxial connector 100 and a microstrip line 200 is the most popular transition between transmission lines, and is often encountered in setups for device testing and in input/output ports of components for high-frequency applications. The transition described above suffers severe insertion loss at higher frequencies, which can be attributed to two causes and will be discussed in the following.

For the first cause of the insertion loss of the transition, please refer to FIGS. 2A and 2B, where FIG. 2A is a schematic view for the internal electromagnetic field distribution of a coaxial structure while FIG. 2B is a schematic view for the electromagnetic field distribution of a microstrip line. The discontinuity or abrupt change in the electromagnetic field distributions of the two transmission lines at their interface introduces insertion loss to the transition between a coaxial connector and a microstrip line.

That is the first cause of the insertion loss. The insertion loss becomes more severe at higher frequencies, which further restricts the passband of the transition.

For the second cause of the insertion loss of the transition, please refer to FIG. 8, which compares the frequency response of the transition by the present invention to the frequency responses of the transitions by two other designs. A resonant dip is observed at the location of 26.5 GHz from the frequency response of the conventional coaxial-to-microstrip transition 1. This resonant response is caused by the excitation of the first higher-order mode (also known as the "$TE_{11}$ mode") of the conventional flange mount coaxial connector 100, and is considered as the second cause of the insertion loss. The existence of this resonant response introduces severe insertion loss to the frequency response of the transition at higher frequencies In order to let signals propagate between the two transmission lines successfully, the problems related to the first cause or the second cause of the insertion loss of the transition must be solved. The solution for the first cause of the insertion loss of the transition is to provide a buffer at the interface of the coaxial connector and the microstrip line for the transformation of their electromagnetic field distributions inside to reduce the insertion loss caused by the abrupt change of the field distributions. The solution for the second cause of the insertion loss of the transition requires the attenuation or even elimination of the resonant response caused by the excitation of the first higher-order mode (the $TE_{11}$ mode) of the conventional coaxial connector 100 from the frequency response of the transition.

SUMMARY OF THE INVENTION

One of the objects of the present invention is to provide a method to design and assemble a connector for the transition between a coaxial cable and a microstrip line with the feature of the attenuation or even elimination of a resonant response caused by the excitation of the first higher-order mode of the conventional coaxial connector from the frequency response of the transition so that the problem related to the second cause of the insertion loss described in the prior arts can be effectively solved.

In order to achieve one of or all of the aforementioned goals, the proposed invention presents a method to design and assemble a connector for the transition between a coaxial cable and a microstrip line. The method includes the following: providing a metallic ring and a conventional coaxial connector, wherein the metallic ring has a through hole, and the conventional coaxial connector comprises a center conductor, an external conductor, and a first dielectric body used to fill up the space between the center conductor and the external conductor, the metallic ring and the center conductor of the conventional coaxial connector are suitably configured into a coaxial structure with a second dielectric body, which is different from the first dielectric body and is used to fill up the space between the inner wall of the through hole and the center conductor; providing a first calculation formula relating a plurality of parameters including the characteristic impedance of the coaxial structure, the radius of the center conductor, the inner radius of the through hole, and the dielectric constant of the second dielectric body, wherein the second dielectric body is air; giving a predetermined value for the characteristic impedance to calculate the inner radius of the through hole by means of the first calculation formula; placing the mounting wall of the conventional coaxial connector against one side of the metallic ring and having the center conductor of the conventional coaxial connector enter the through hole from that side of the metallic ring via the geometric center of the through hole, and then having the leading portion of the center conductor exit the through hole from the other side of the metallic ring; and establishing a transition structure by placing a microstrip line next to the other side of the metallic ring, wherein the signal line of the microstrip line is connected to the center conductor coming out of the through hole of the metallic ring, but not inserted into the through hole, all of the external conductor of the conventional coaxial connector, the metallic ring, and the ground plane of the microstrip line are electrically connected with one another by some means.

In an embodiment, the method further includes the following: providing a second calculation formula relating a plurality of parameters including the cutoff frequency for the first higher-order mode of the coaxial structure, the radius of the center conductor, the inner radius of the through hole, and the dielectric constant of the second dielectric body; and calculating the value of the inner radius of the through hole by means of the first calculation formula, and then using the value of the inner radius of the through hole to calculate the cutoff frequency for the first higher-order mode of the coaxial structure according to the second calculation formula.

In an embodiment, the first calculation formula is expressed as $$Z_0 = \frac{60}{\sqrt{\epsilon_r}} \ln\left(\frac{b}{a}\right),$$

and the second calculation formula is expressed as $$f_c = \frac{c\left(\frac{2}{a+b}\right)}{2\pi\sqrt{\epsilon_r}},$$

where $Z_0$ denotes the characteristic impedance of the coaxial structure, $f_c$ denotes the cutoff frequency for the first higher-order mode of the coaxial structure, $\varepsilon_r$ denotes the dielectric constant of the second dielectric body, a denotes the radius of the center conductor, b denotes the inner radius of the through hole of the metallic ring, and c denotes a constant value of $3\times10^8$ m/s.

In an embodiment, the method further includes the following: determining a designed thickness for the metallic ring based on the relationship between the 1-dB passband of the transition and the thickness of the metallic ring, as well as the other relationship between the $S_{11}$ frequency response and the thickness of the metallic ring. For example, the designed thickness is 1.5 mm.

In an embodiment, the method further includes the following: having the center conductor of the conventional coaxial connector pass through the through hole of the metallic ring via the geometric center of the through hole, subsequently connecting the center conductor of the conventional coaxial connector coming out of the through hole to the signal line of the microstrip line on the other side of the metallic ring horizontally to establish a horizontal transition. In the horizontal transition, the characteristic impedance of the coaxial structure is 50 ohm, the inner radius of the through hole is 1.46 mm, the thickness of the metallic ring is 1.5 mm, and the cutoff frequency for the first higher-order mode of the coaxial structure reaches 45.6 GHz.

In an embodiment, the method further includes the following: placing the microstrip line inside a metallic box with four metallic walls; creating a circular through hole in one of the metallic walls, wherein the circular through hole has a designed radius calculated by the first calculation formula with a predetermined value for the characteristic impedance; replacing the metallic ring by the metallic wall with the circular through hole; and having the center conductor of the conventional coaxial connector enter from the outside of the metallic box via the geometric center of the circular through hole in the metallic wall and then into the metallic box; subsequently connecting the center conductor of the conventional coaxial connector to the signal line of the microstrip line to establish a horizontal transition.

In an embodiment, the method further includes the following: providing a coplanar waveguide to replace the microstrip line, wherein the coplanar waveguide comprises a central signal line on top of a substrate and two ground planes disposed at the two sides of the central signal line; and connecting the central signal line of the coplanar waveguide to the center conductor coming out of the through hole of the metallic ring, wherein the central signal line is not inserted into the through hole.

In an embodiment, the method further includes the following: having the center conductor of the conventional coaxial connector pass through the through hole of the metallic ring from bottom to top via the geometric center of the through hole, subsequently connecting the center conductor coming out of the through hole to the signal line of the micro strip line vertically to establish a vertical transition.

In an embodiment, the inner diameter of the through hole of the metallic ring, which is calculated by means of the first calculation formula, is less than the inner diameter of the external conductor of the conventional coaxial connector.

In an embodiment, the conventional coaxial connector is a panel mount coaxial connector featuring a mounting wall with a plurality of mounting pedestals around the edge of the mounting wall. And the method includes the following: creating a plurality of notches around the edge of the metallic ring to form a modified metallic ring, wherein each of the notches allows the corresponding mounting pedestal to pass through the modified metallic ring so that the modified metallic ring can be placed next to the mounting wall of the panel mount coaxial connector with the center conductor of the conventional coaxial connector passing through the through hole of the modified metallic ring via the geometric center of the through hole.

The method of the present invention features well-designed values for the thickness of the metallic ring and the inner diameter of the through hole of the metallic ring, as well as proper assembly for the transition so that the resonant response caused by the excitation of the first higher-order mode of the conventional coaxial connector can be attenuated or even eliminated from the frequency response of the transition, which leads to not only the improvement of the insertion loss of the transition between the two transmission lines at high frequencies, but also the increase of the 1-dB passband of the transition.

DESCRIPTION OF THE PREFERRED EMBODIMENTS

In the following the details of a preferred embodiment accompanied by its corresponding drawings clearly explain the early statements on this invention and other technical contents, features, and functions. In this regard, the direction-related terms, such as "top," "bottom," "left," "right," "front," "back," etc., are used with reference to the orientations of the objects in the Figure(s) being considered. The components of the present invention can be positioned in a number of different orientations. As such, the direction-related terms are used for the purposes of illustration and by no means as restrictions to the present invention. On the other hand, the sizes of objects in the schematic drawings may be overstated for the purpose of clarity. It is to be understood that other likely-employed embodiments or possible changes made in the structure of the present invention should not depart from the scope of the present invention. Also, it is to be understood that the phraseology and the terminology used herein are for the purpose of description and should not be regarded as limits to the present invention. The use of "including," "comprising," or "having" and variations thereof herein is meant to cover the items listed thereafter and equivalents thereof as well as additional items. Unless otherwise stated, the terms "connected," "coupled," and "mounted" and variations thereof herein are used in a broad sense and cover direct and indirect connections, couplings, and mountings. Similarly, the terms "facing," "faces" and variations thereof herein are used in a broad sense and cover direct and indirect facing, and the term "adjacent to" and variations thereof herein is used in a broad sense and cover directly and indirectly "adjacent to". Therefore, the description of "A" component facing "B" component herein may include the situations that "A" component facing "B" component directly or one or more additional components between "A" component and "B" component. Also, the description of "A" component "adjacent to" "B" component herein may include the situations that "A" component is directly "adjacent to" "B" component or one or more additional components between "A" component and "B" component. Accordingly, the drawings and the descriptions will be regarded as illustrative in nature, but not restrictive.

Figure 3A:
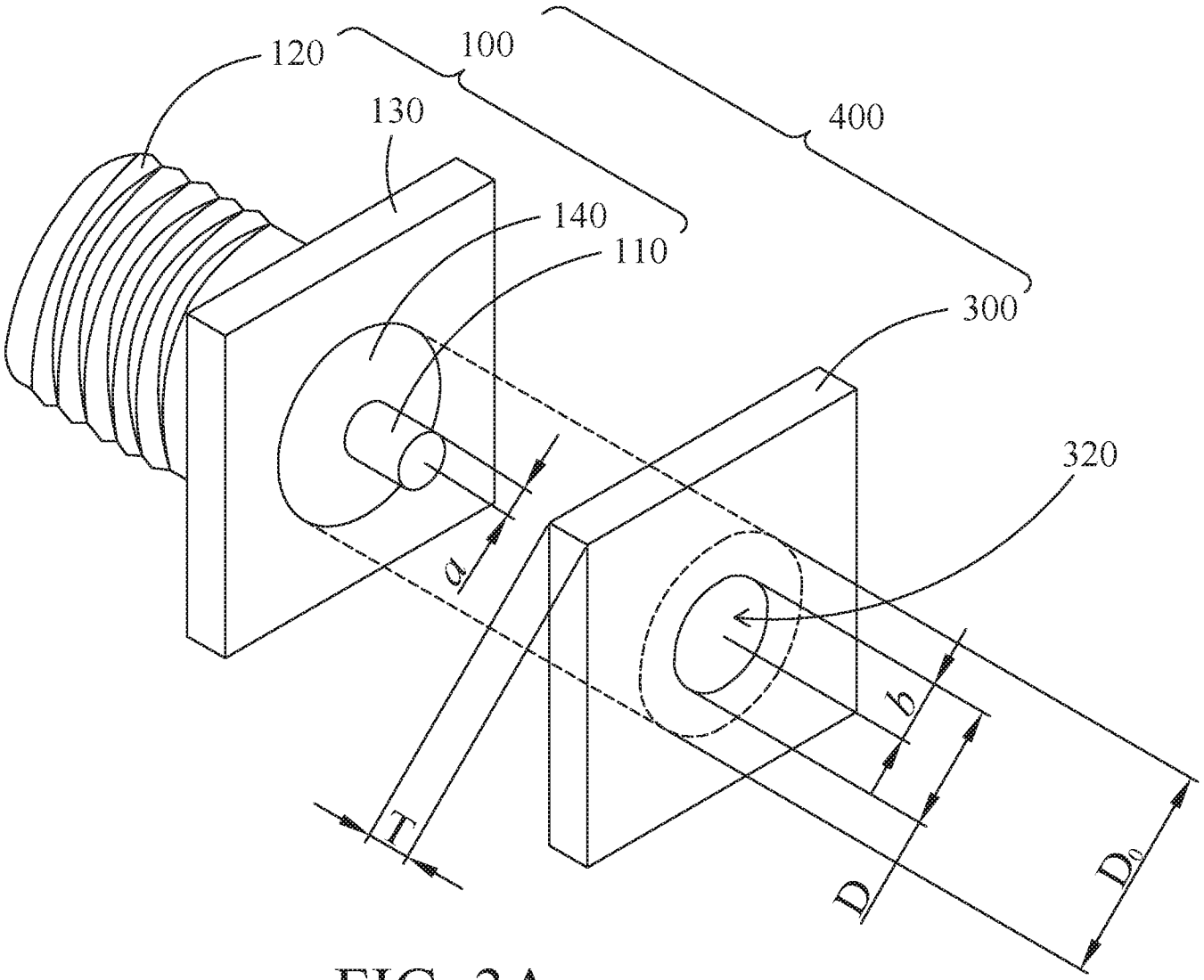
FIGS. 3A to 3C are the schematic views showing the method to design and assemble a connector for a transition between a coaxial cable and a microstrip line, which is the first exemplary embodiment of the present invention.
Figure 3B:
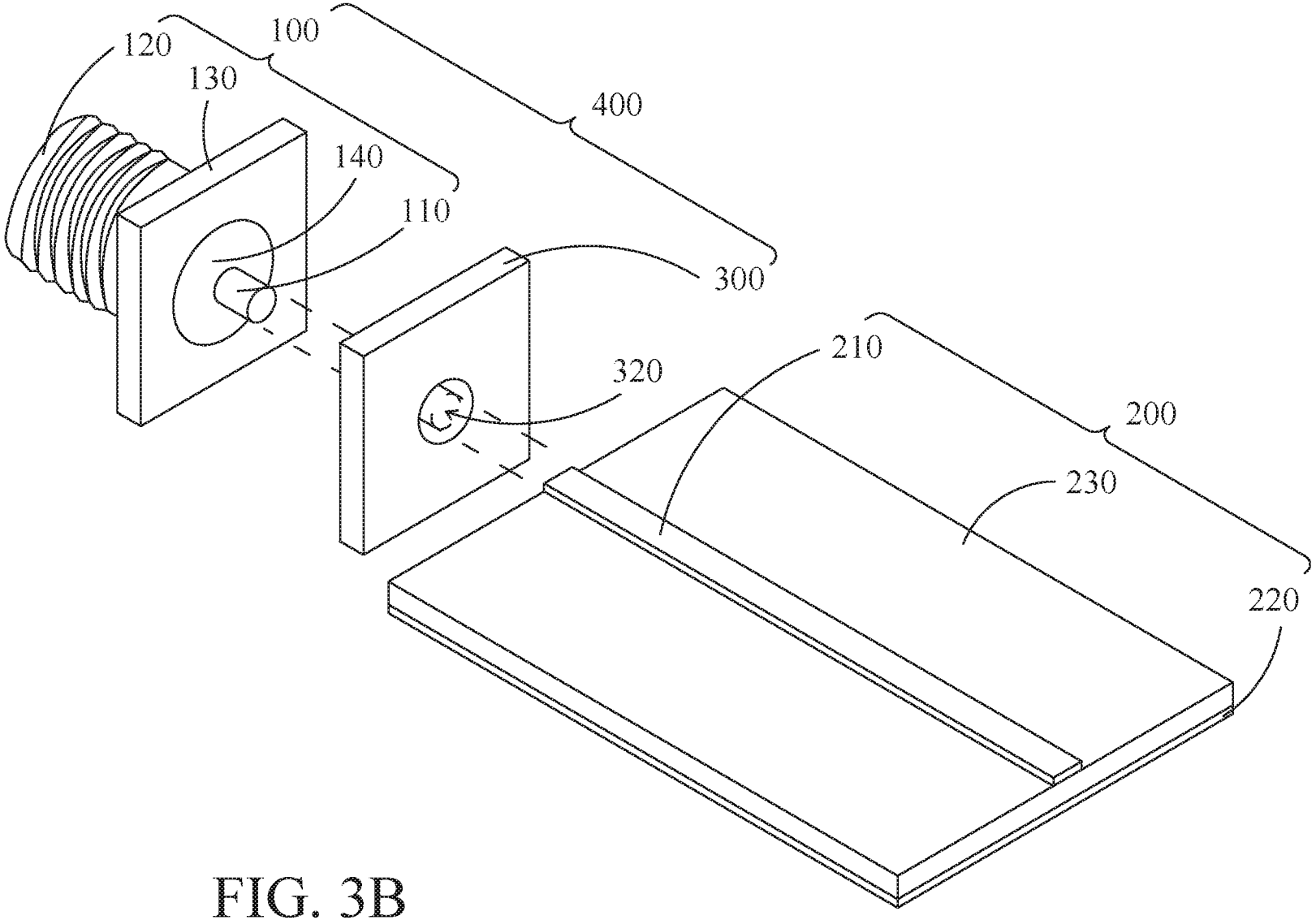
Figure 3C:
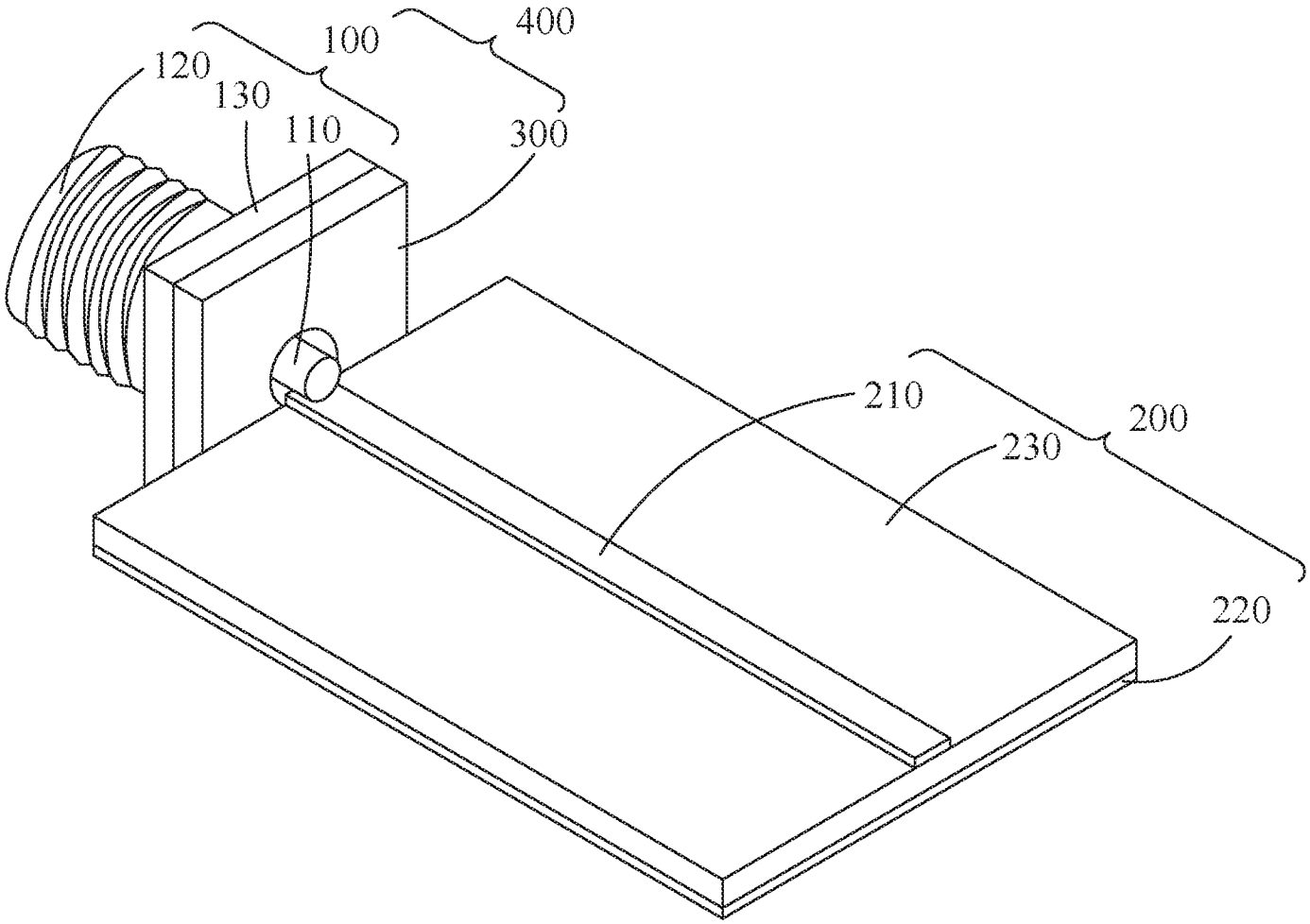
Figure 8:
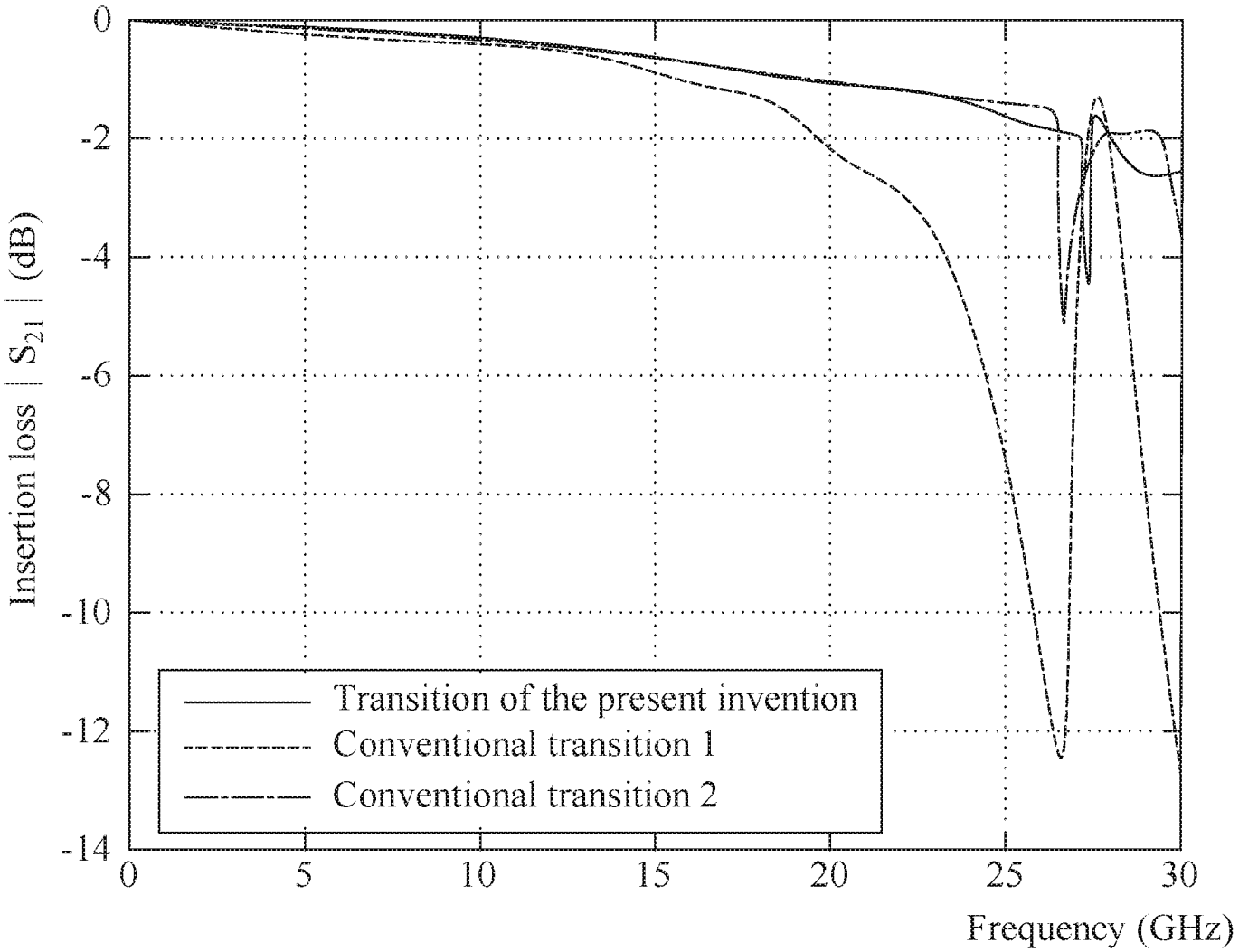
FIG. 8 is the plot showing the comparison on the frequency responses of the transition by the present invention and the transitions by two other designs.

FIGS. 3A to 3C show the first exemplary embodiment of the present invention for a transition between a coaxial cable and a microstrip line. A new coaxial connector 400 is created by placing a metallic ring 300 with a through hole 320 against the mounting wall 130 of a conventional coaxial connector 100 as shown in FIG. 3A, and then integrating them into one piece. In an embodiment, the conventional coaxial connector 100 is also known as a flange mount coaxial connector 100. The new coaxial connector 400 is suitable to establish a transition between a coaxial cable 10 and a microstrip line 200 or a coplanar waveguide 600. Referring to FIG. 8, a severe resonant dip is observed from the frequency response of the conventional transition 1. The resonant response is caused by the excitation of the first higher-order mode (also known as the "$TE_{11}$ mode") of the flange mount coaxial connector 100, and is considered as the second cause of the insertion loss in the description of the prior art. The inner diameter D of the through hole 320 and the thickness T of the metallic ring 300 are the critical parameters to determine the frequency response of the transition so that by well designing the inner diameter D and the thickness T, and properly assembling the new coaxial connector 400, the resonant response caused by the excitation of the first higher-order mode of the flange mount coaxial connector 100 can be attenuated or even eliminated from the frequency response of the transition, which leads to not only the improvement of the insertion loss of the transition at higher frequency, but also the substantial enhancement of its 1-dB passband. The innovative design and assembly of the new coaxial connector 400 are shown in FIGS. 3A to 3C, wherein FIG. 3A is the perspective view showing that the new coaxial connector 400 comprises a conventional coaxial connector 100 and a metallic ring 300 in an exemplary embodiment of the present invention; FIG. 3B is the perspective view showing a transition to be established between the new coaxial connector 400 and a microstrip line 200 in the exemplary embodiment of the present invention; and FIG. 3C is the perspective view showing the established transition between the new coaxial connector 400 and the microstrip line 200 in the exemplary embodiment of the present invention.

FIGS. 3A and 3B are the schematic views showing the method to design and assemble a new coaxial connector 400 for a transition between a coaxial cable and a microstrip line in an exemplary embodiment of the present invention. The procedure includes the following: prepare a metallic ring 300 with a through hole 320, as well as a conventional coaxial connector 100 comprising a center conductor 110, an external conductor 120, and a dielectric body 140 of Teflon used to fill up the space between the center conductor 110 and the external conductor 120; then have the metallic ring 300 placed against the mounting wall 130 of the conventional coaxial connector 100 with the center conductor 110 penetrating the through hole 320 of the metallic ring 300 to constitute a coaxial structure with air as a dielectric body to fill up the space between the inner wall of the through hole 320 and the center conductor 110; thus, a new coaxial connector 400 is created.

Searching for the proper value for the inner diameter D of the through hole 320 of the metallic ring 300 is a critical step for the present invention since the inner diameter D of the through hole 320 is an important factor to determine the characteristic impedance of the coaxial structure and the cutoff frequency for the first higher-order mode of the coaxial structure. To find a suitable value for the inner diameter D of the through hole 320, a "first calculation formula" is provided by the present invention to relate parameters including the characteristic impedance $Z_0$ of the coaxial structure with a predetermined value, the dielectric constant $\varepsilon_r$ of the air dielectric, which is equal to "1", the radius a of the center conductor with a known value, and the inner radius b of the through hole with an unknown value. The unknown value of the inner diameter D of the through hole 320 is calculated by means of the "first calculation formula".

The first calculation formula is expressed as follows:

$$Z_0 = \frac{60}{\sqrt{\epsilon_r}} \ln\left(\frac{b}{a}\right),$$

where $Z_0$ denotes the characteristic impedance of the coaxial structure, $\varepsilon_r$ denotes the dielectric constant of the air dielectric, a denotes the radius of the center conductor 110, and b denotes the inner radius of the through hole 320 of the metallic ring 300.

Given a predetermined value for the characteristic impedance $Z_0$, the value for the inner radius b of the through hole 320 can be obtained from the first calculation formula. A second calculation formula is provided to relate parameters including the cutoff frequency $f_c$ for the first higher-order mode of the coaxial structure, a constant value c of $3\times10^8$ m/s, and other parameters from the first calculation formula including the dielectric constant $\varepsilon_r$ of a second dielectric body, namely the air dielectric, with the value of 1, the radius a of the center conductor, and the inner radius b of the through hole 320. Then, based on the second calculation formula, the cutoff frequency $f_c$ for the first higher-order mode of the coaxial structure can be obtained with the values of other parameters available.

The second calculation formula is expressed as follows:

$$f_c = \frac{c\left(\frac{2}{a+b}\right)}{2\pi\sqrt{\epsilon_r}},$$

where $f_c$ denotes the cutoff frequency for the first higher-order mode of the coaxial structure, $\varepsilon_r$ denotes the dielectric constant of the air dielectric, a denotes the radius of the center conductor 110, b denotes the inner radius of the through hole 320 of the metallic ring 300, and c denotes the constant value of $3\times10^8$ m/s.

Notably, the first calculation formula and the second calculation formula presented previously are also applicable to calculate the related parameters for the conventional coaxial connector 100 except that the parameter $\varepsilon_r$ denotes the dielectric constant of the dielectric body 140 between the center conductor 110 and the external conductor 120, and the parameter b denotes the inner radius of the external conductor 120. Nevertheless, the new coaxial connector 400 of the present invention features an additional metallic ring 300 compared to the conventional coaxial connector 100. Furthermore, the first calculation formula and the second calculation formula employed in the exemplary embodiment are applied to the coaxial structure therein comprising the metallic ring 300 and the center conductor 110 of the conventional coaxial connector 100 to determine the optimum inner radius b of the through hole 320, which further results in a higher cutoff frequency $f_c$ for the first higher-order mode of the coaxial structure compared to that of the conventional coaxial connector 100. Therefore, the novelty, the technical approaches, and the results introduced by the present invention are far beyond the imagination of the professionals with common knowledges in this art.

Moreover, the optimum thickness T of the metallic ring 300 can be determined from the relationship between the thickness T of the metallic ring 300 and the 1-dB passband of the transition since the 1-dB passband varies as the thickness T changes. A table illustrating the relationship between the thickness T of the metallic ring 300 and the 1-dB passband of a horizontal transition from an exemplary embodiment of the present invention is shown below.

| Thickness T of the metallic ring | 1-dB passband |
|---|---|
| T = 0.5 mm | 19.75 GHz |
| T = 1 mm | 19.88 GHz |
| T = 1.5 mm | 19.89 GHz |
| T = 2 mm | 19.93 GHz |
| T = 2.5 mm | 19.85 GHz |
| T = 3 mm | 19.82 GHz |
| T = 3.5 mm | 19.80 GHz |

From the table, the three 1-dB passbands corresponding to the three thicknesses 1 mm, 1.5 mm, and 2 mm, respectively, are almost the same. Moreover, the 1-dB passband decreases as the thickness is outside this range. It may seem that the thickness 2.0 mm is the optimum thickness for the metallic ring 300. However, from the engineering viewpoint, compared to the thickness 2.0 mm, the thickness 1.5 mm for the metallic ring 300 offers the advantages of smaller size, lighter weight, and more tolerance for fabrication errors leading to unexpected decrease in the 1-dB passband of the transition. Accordingly, based on this preliminary evaluation, the preferred value for the thickness T of the metallic ring 300 of the present invention is 1.5 mm.

Figure 7:
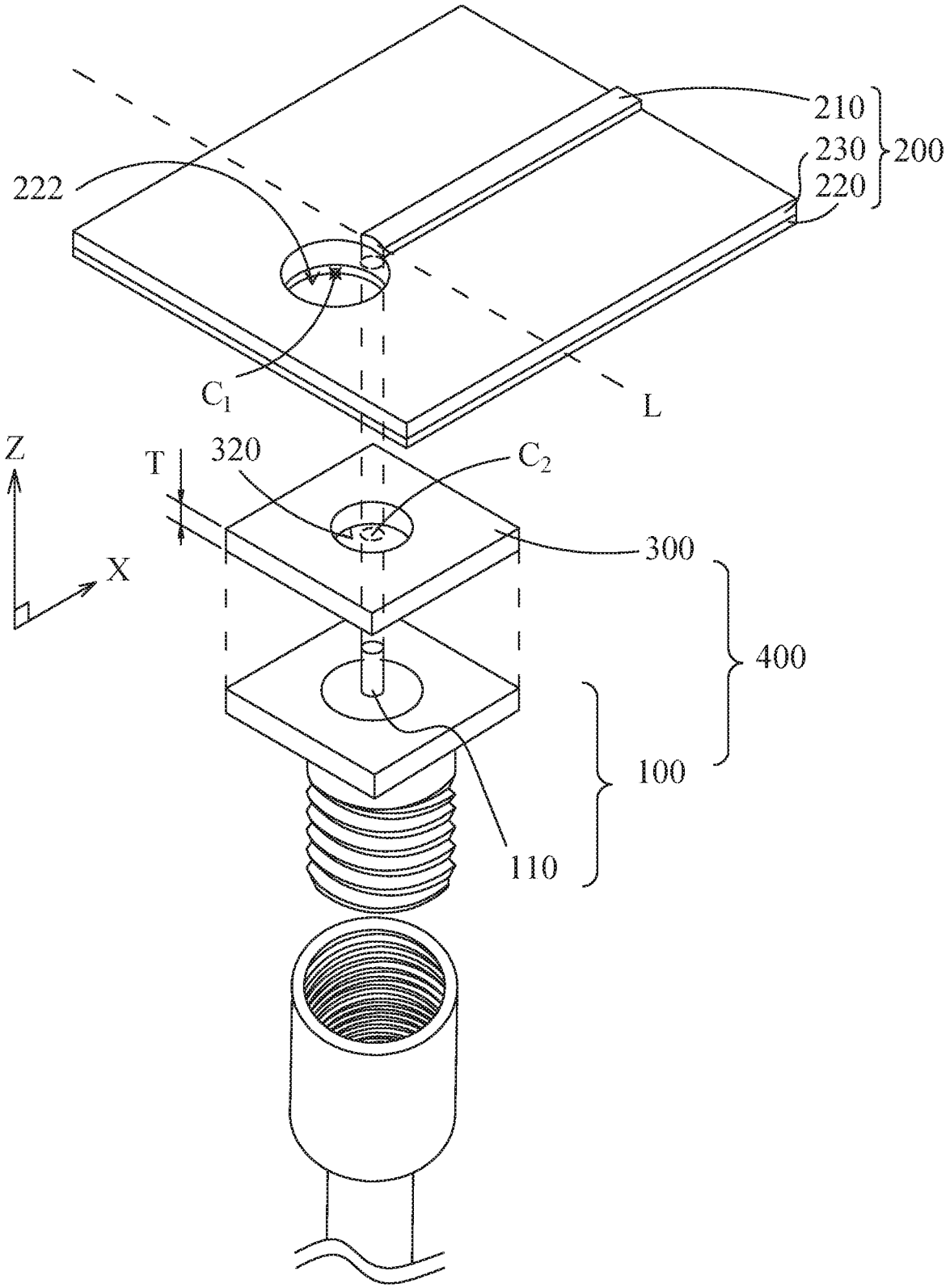
FIG. 7 is the schematic view for the fifth exemplary embodiment of the present invention applied to a vertical transition.

In addition to the relationship between the thickness T of the metallic ring 300 and the 1-dB passband of the transition, the relationship between the thickness T of the metallic ring 300 and the $S_{11}$ frequency response of the transition should be taken into account to determine the final value for the thickness T of the metallic ring 300. The $S_{11}$ frequency response is the ratio of the signal reflected from a transition to the signal incident to the transition at different frequency points. The $S_{11}$ frequency responses of a transition from an exemplary embodiment with the thickness T of the metallic ring equal to the previous three values show that the $S_{11}$ performance of the transition varies from one thickness to the other over different frequency ranges. However, in general, the $S_{11}$ frequency response of the transition subject to the thickness T=2.0 mm for the metallic ring 300 is better than the performance subject to the thickness T=1.5 mm, which also outperforms the thickness T=1.0 mm on the $S_{11}$ frequency response of the transition. However, for another exemplary embodiment of the present invention, a vertical transition as shown in FIG. 7, the performance on the $S_{11}$ frequency responses of the vertical transition subject to the three values for the thickness of the metallic ring is opposite to the performance of the horizontal transition presented early. Judging the overall performance and considering the applications of the present invention for both horizontal and vertical transitions, the final value for the thickness T of the metallic ring 300 of the present invention is chosen to be 1.5 mm.

Since the method to design and assemble a new coaxial connector 400 for a transition between a coaxial cable and a microstrip line 200 in an exemplary embodiment of the present invention has been disclosed previously, more details associated with FIGS. 3B and 3C are described below. As shown in FIG. 3B, place the conventional coaxial connector 100 and the microstrip line 200 at the opposite sides of the metallic ring 300, respectively. Subsequently, have the center conductor 110 of the conventional coaxial connector 100 enter the through hole 320 of the metallic ring 300 from one side of the metallic ring 300 through the geometric center of the through hole 320 and then have the leading portion of the center conductor 110 exit the through hole 320 from the other side of the metallic ring 300. The conventional coaxial connector 100 and the microstrip line 200 are attached to the metallic ring 300 from different sides so that the leading portion of the center conductor 110 is physically connected to the signal line 210 of the microstrip line 200. Finally, the external conductor 120 of the conventional coaxial connector 100, the metallic ring 300, and the ground plane 220 of the microstrip line 200 are all electrically connected by any means. It is worth noting that the signal line 210 is connected to the center conductor 110 outside the through hole 320 of the metallic ring 300 and is not inserted into the inside of the through hole 320. In the embodiment of the present invention, both the center conductor 110 and the microstrip line 200 are placed horizontally to establish a horizontal transition.

Please refer to FIG. 3C, which shows an assembled new coaxial connector 400 and a microstrip line 200 with a substrate 230. The new coaxial connector 400 comprises a metallic ring 300 with a through hole 320 and a conventional coaxial connector 100, which is a popular flange mount coaxial connector, especially this type—flange mount Sub-Miniature version A (abbreviated as "SMA") connector. For the substrate 230 of the microstrip line 200, the dielectric coefficient thereof is 6.15, the thickness thereof is 0.813 mm, and the dimensions thereof are 20 mm×30 mm. To determine the inner radius b of the through hole 320 of the metallic ring 300, the first calculation formula is applied with the characteristic impedance $Z_0$ of the coaxial structure equal to 50Ω (ohm), the radius a of the center conductor 110, which is a standard dimension for the SMA connectors, equal to 25 mil or 0.635 mm, and the dielectric constant of the air dielectric within the through hole 320 equal to 1. With these information available, the inner radius b of the through hole 320 of the metallic ring 300 is obtained as 57.5 mil or 1.461 mm by means of the first calculation formula. To determine the thickness T of the metallic ring 300, referring to the table showing the relationship between the thickness T of the metallic ring 300 and the 1-dB passband of a transition from an exemplary embodiment of the present invention, and considering the effect of the thickness T of the metallic ring 300 on the $S_{11}$ frequency responses of both horizontal and vertical transitions, the preferred value for the thickness T of the metallic ring 300 of the present invention is 1.5 mm. Moreover, to determine the cutoff frequency $f_c$ for the first higher-order mode of the air-filled coaxial structure from the new coaxial connector 400, the second calculation formula is applied with the values of all other related parameters available, and the corresponding value for the cutoff frequency $f_c$ is obtained as 45.6 GHz. The cutoff frequency $f_c$ for the first higher-order mode of the air-filled coaxial structure from the new coaxial connector 400, 45.6 GHz, is much higher than that of the conventional coaxial connector 100, which is equal to 25.1 GHz. Therefore, the resonant response caused by the excitation of the first higher-order mode of the conventional coaxial connector 100 at 26.5 GHz (as can be seen from the "Conventional transition 1" curve in FIG. 8) can be attenuated or even eliminated to increase the 1-dB passband of the transition.

The parameters appearing in the first calculation formula and the second calculation formula of the present invention are illustrated as below. The inner diameter D of the through hole 320 of the metallic ring 300 is 2.92 mm, less than the inner diameter $D_0$ of the external conductor 120 of the conventional coaxial connector 100, which is equal to 4.12 mm. Basically, there is no restriction on the size and configuration of the metallic ring 300; however, allowing the metallic ring 300 and the mounting wall 130 of the SMA flange mount coaxial connector 100 to share the same square configuration and the same size of 12.7 mm×12.7 mm would lead to ease in assembly and integration of the two pieces and low in fabrication cost of the new coaxial connector 400.

Figure 4:
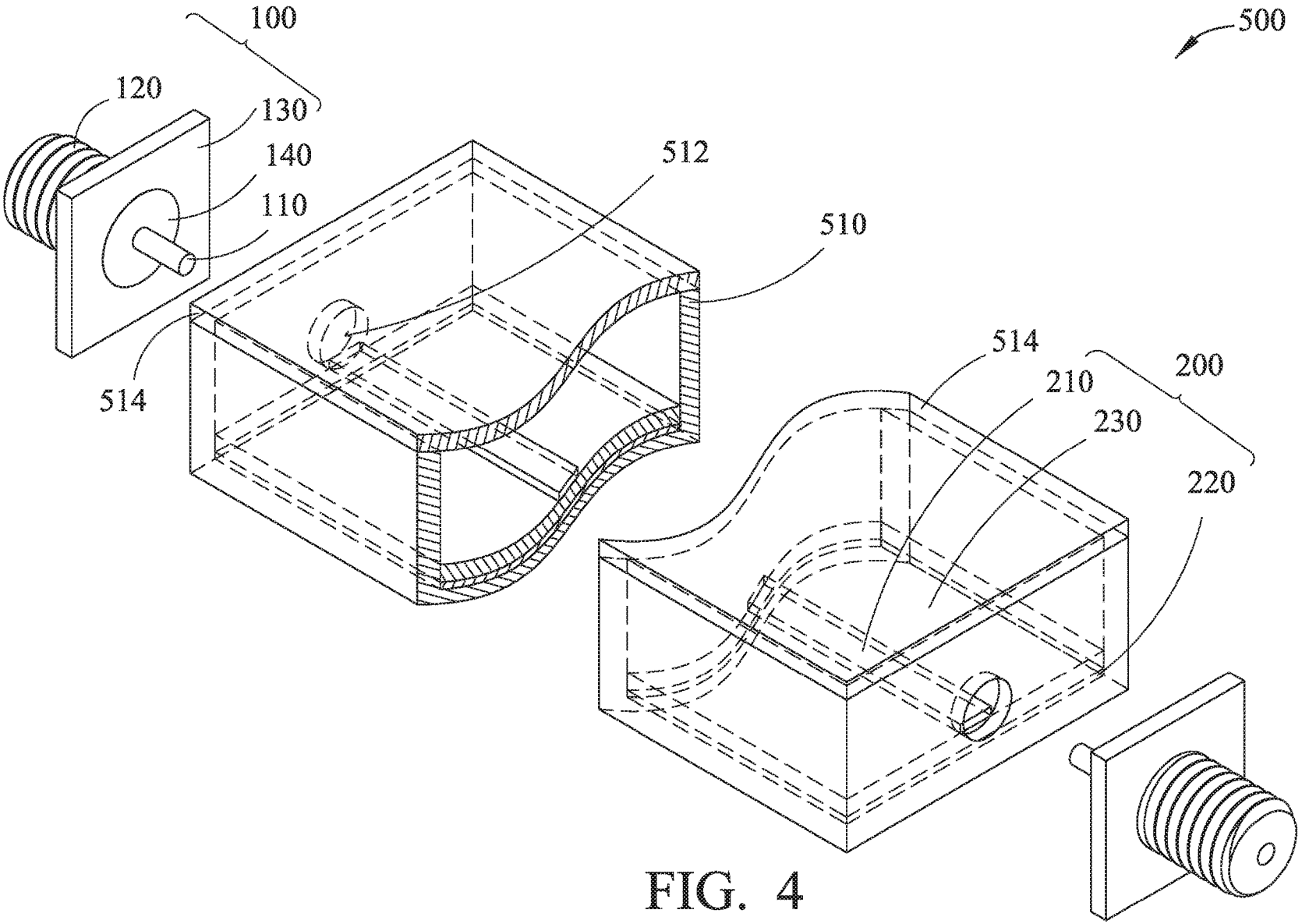
FIG. 4 is the schematic view for the second exemplary embodiment of the present invention applied to a microwave component.

FIG. 4 shows the second exemplary embodiment of the present invention applied to the transition at each coaxial port of a two-port microwave component 500. The microwave component 500 is constructed by implementing circuits inside a closed metallic box 510 to prevent improper electromagnetic couplings and interference. The circuits use microstrip lines 200 as its input and output ports, which subsequently are connected to two external conventional coaxial connectors 100 for the purpose of device testing and system integration. The metallic box 510 of the microwave component 500 comprises two metallic walls lateral to the signal line 210 of the microstrip line 200, a front metallic wall and a rear metallic wall with each featuring a circular through hole 512 therein, a base to support the circuits and the microstrip lines 200, and a top cover 514 to completely seal the metallic box 510. The conventional coaxial connector 100 and the microstrip lines 200 remain the same as those disclosed in the previous paragraphs. The two conventional coaxial connectors 100 are placed next to the front metallic wall and the rear metallic wall, respectively, from the outside to function as the input port and output port of the microwave component 500 for the purpose of device testing or system integration. Note that the dielectric body 140 does not extend out of the mounting wall 130 of the conventional coaxial connector 100. The radius of the circular through hole 512 in the front or the rear metallic wall can be obtained from the first calculation formula with predetermined values for the characteristic impedance $Z_0$ and other related parameters. The front or the rear metallic wall and the circular through hole 512 therein serve the same purpose as the metallic ring 300 and the through hole 320 thereof in the previous exemplary embodiment to attenuate or even eliminate the resonant response caused by the excitation of the first higher-order mode of the conventional coaxial connector 100 from the frequency response of the transition, and therefore to enhance the 1-dB passband of the transition. It means that the front or the rear metallic wall and the circular through hole 512 therein in this exemplary embodiment replace the metallic ring 300 and the through hole 320 thereof in the previous exemplary embodiment. By following the same procedure as in the previous exemplary embodiment, the leading portion of the center conductor 110 of each conventional coaxial connector 100 enters inside the metallic box 510 through the circular through hole 512 and is connected to the signal line 210 of the microstrip line 200. Note that the signal line 210 is not inserted into the circular through hole 512 in the metallic wall. The applications of the present invention are not confined to two-port microwave components. In general, it is applicable to any N-port components, where N is an integer greater than 0.

Figure 5:
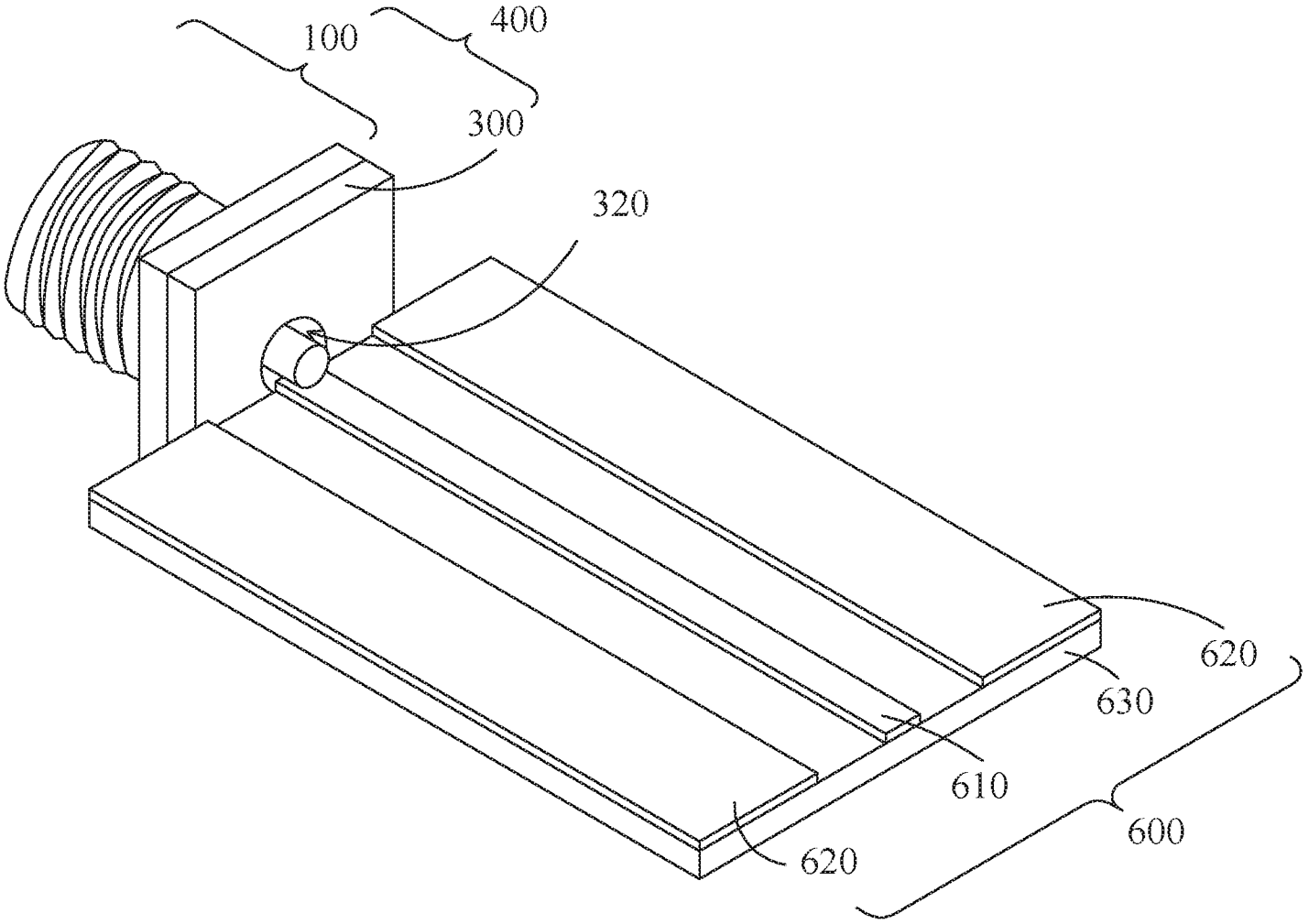
FIG. 5 is the schematic view for the third exemplary embodiment of the present invention applied to a coplanar waveguide.

FIG. 5 shows the third exemplary embodiment of the present invention applied to a transition between the new coaxial connector 400 and a coplanar waveguide 600. The coplanar waveguide 600 comprises a central signal line 610, a substrate 630, and two lateral ground planes 620 such that the central signal line 610 is placed longitudinally between the two lateral ground planes 620, and all are disposed on the upper surface of the substrate 630. The new coaxial connector 400 comprising a conventional coaxial connector 100 and a metallic ring 300 remains the same as those disclosed in the previous paragraphs. The coplanar waveguide 600 and the central signal line 610 thereof in this exemplary embodiment replace the microstrip line 200 and the signal line 210 thereof in the previous exemplary embodiment. By following the same procedure as in the previous exemplary embodiment, the leading portion of the center conductor 110 of the conventional coaxial connector 100 outside the metallic ring 300 is connected to the central signal line 610 of the coplanar waveguide 600. Note that the central signal line 610 is not inserted into the through hole 320 of the metallic ring 300.

Figure 6A:
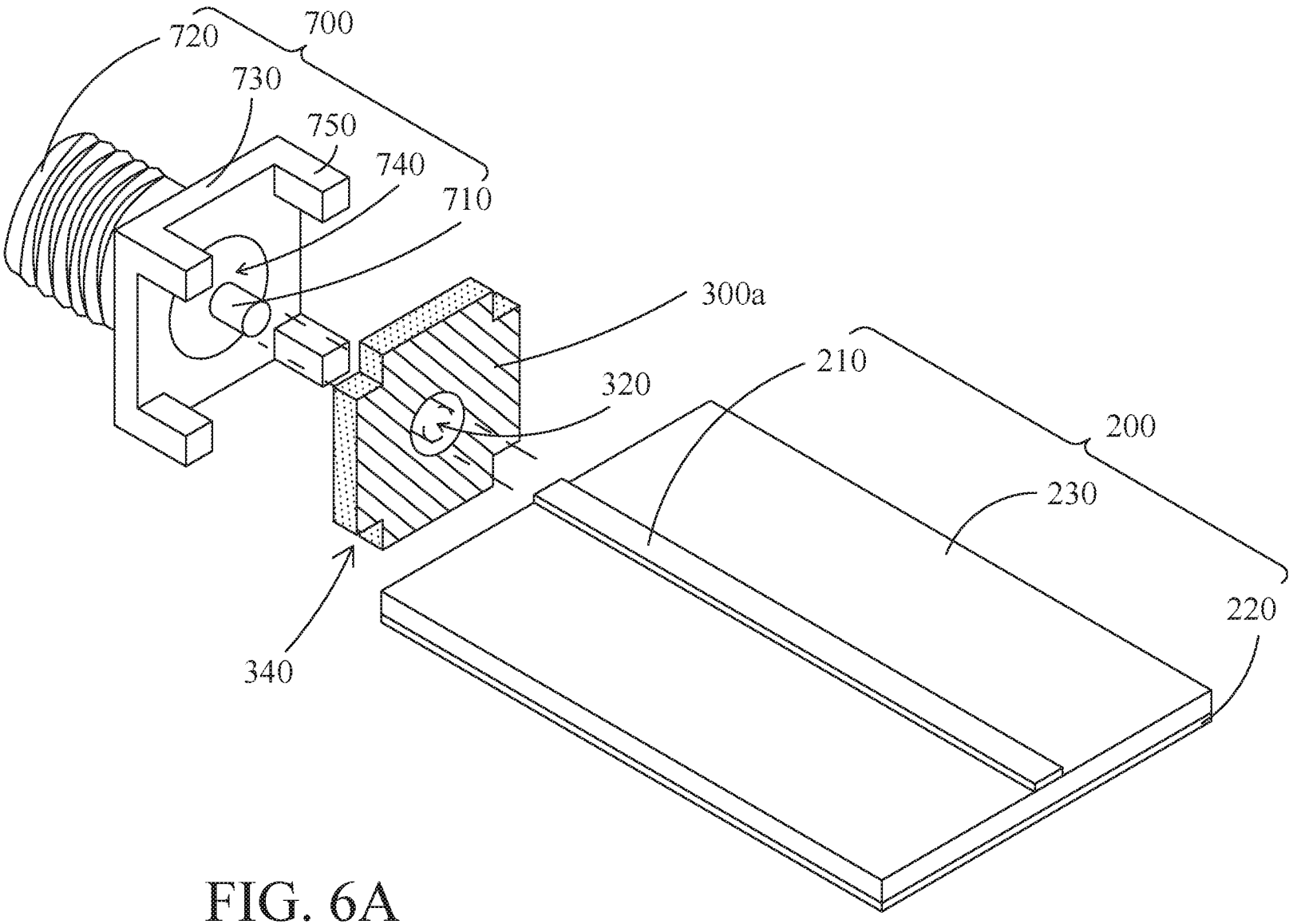
FIGS. 6A and 6B are the schematic views for the fourth exemplary embodiment of the present invention applied to a panel mount coaxial connector.
Figure 6B:
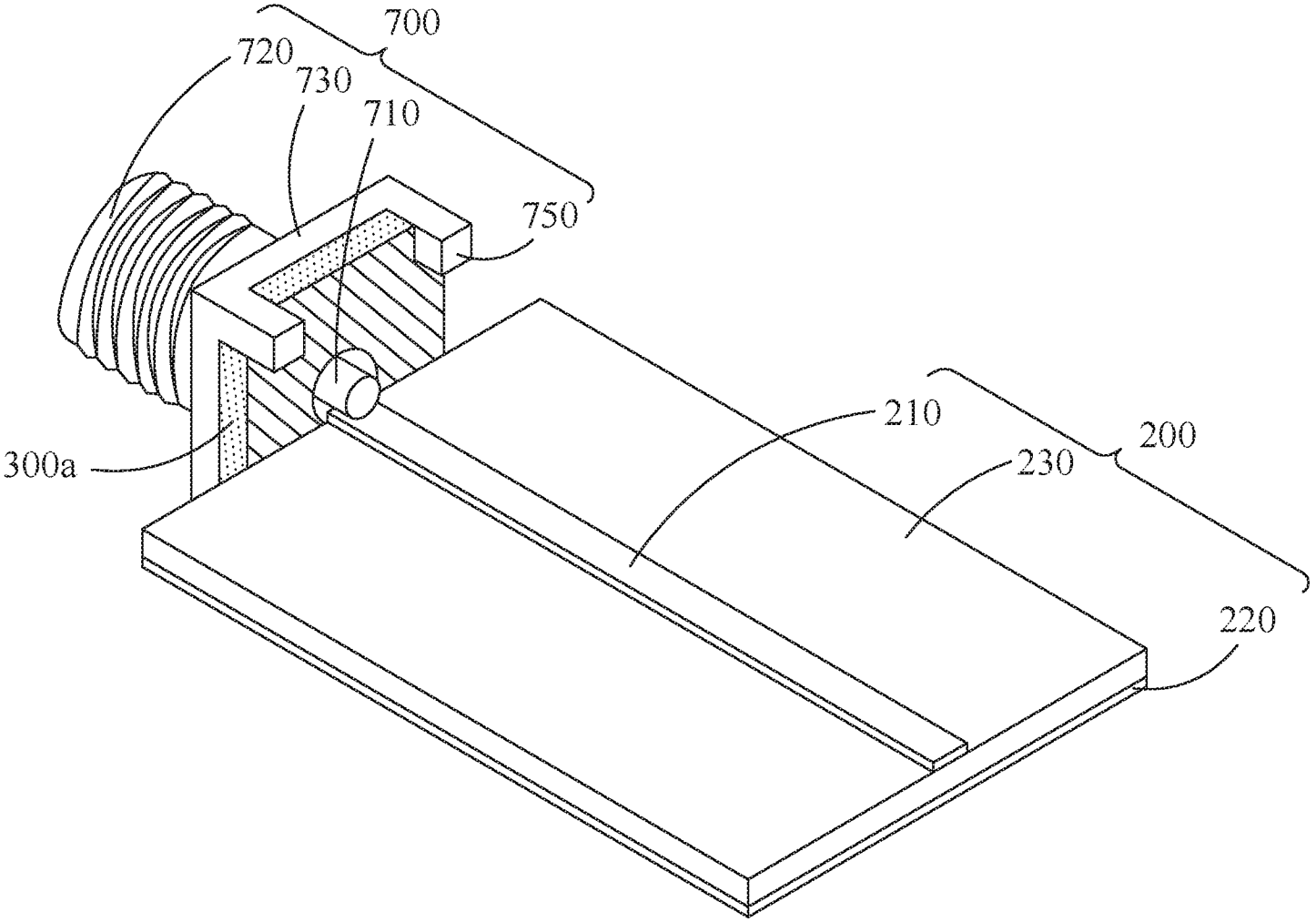

FIGS. 6A and 6B show the fourth exemplary embodiment of the present invention applied to a transition between a microstrip line 200 and a panel mount coaxial connector 700, not the flange mount coaxial connector 100 in the previous embodiments. A modified metallic ring 300*a* placed between the microstrip line 200 and the panel mount coaxial connector 700 has a through hole 320 and four notches 340 at the corners. The panel mount coaxial connector 700 comprises a center conductor 710, an external conductor 720, a mounting wall 730, a dielectric body 740, and four mounting pedestals 750 at the corners of the mounting wall 730 for ease in assembly with the microstrip line 200. The size of the mounting wall 730 is 6.35 mm×6.35 mm, which is smaller than that of its counterpart, the mounting wall 130 of the SMA flange mount coaxial connector 100 with the size of 12.7 mm×12.7 mm. The modified metallic ring 300*a* is designed to have the same configuration and size as the mounting wall 730 of the panel mount coaxial connector 700, but with four notches 340 cut from the corners of the metallic ring 300 in order to allow the corresponding mounting pedestals 750 of the panel mount coaxial connector 700 to pass through the modified metallic ring 300*a* so that the modified metallic ring 300*a* can be placed against the mounting wall 730 to create a new coaxial connector of the present invention. As shown in FIG. 6B, after establishing a transition between the new coaxial connector and the microstrip line 200, two mounting pedestals 750 are underneath the microstrip line 200 while the other two mounting pedestals 750 are above the microstrip line 200. For the purpose of mass production, the panel mount coaxial connector 700 and the modified metallic ring 300*a* can be integrated into one piece.

Figure 1:
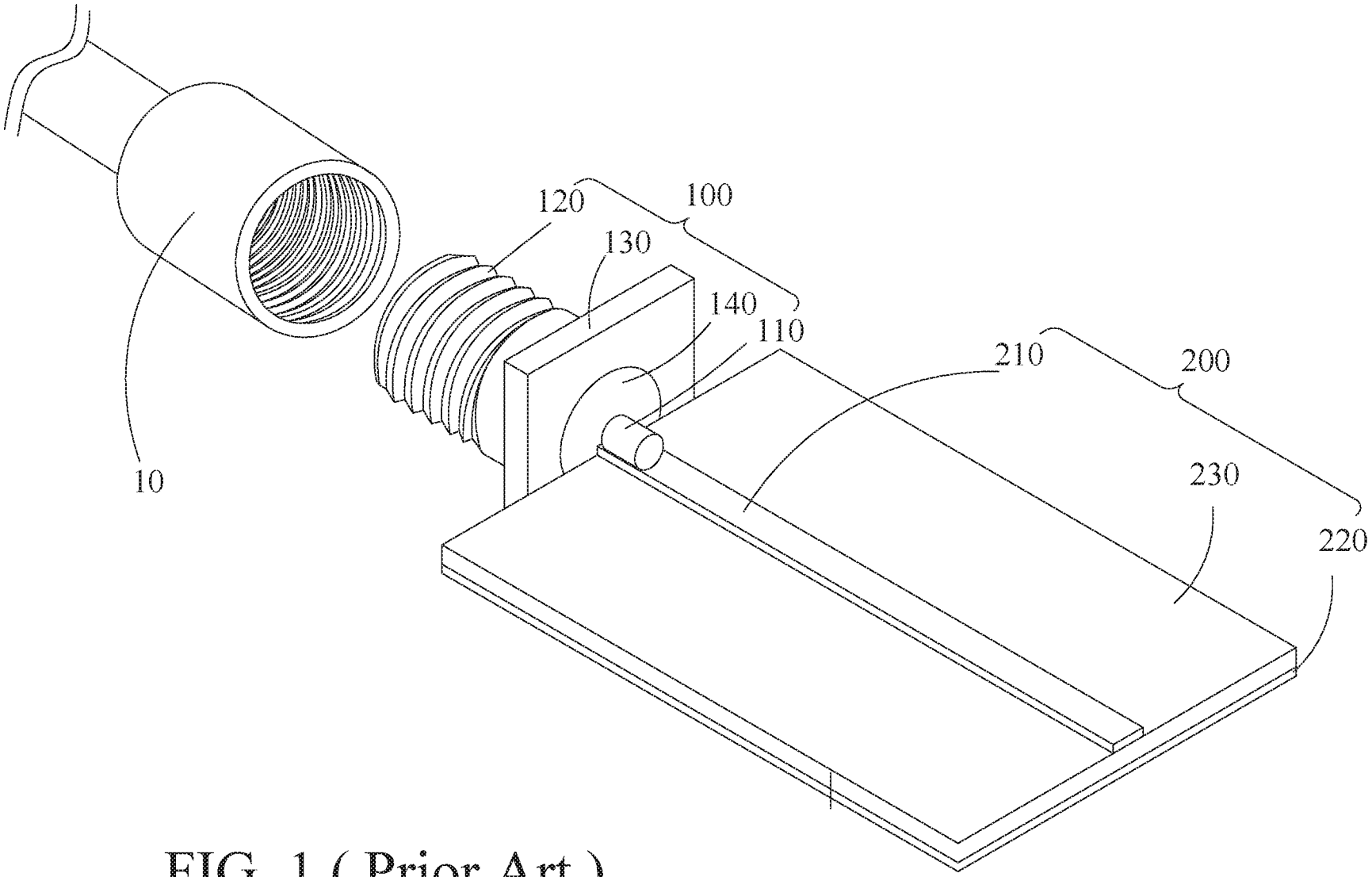
FIG. 1 ( Prior Art )
FIG. 1 is the schematic decomposed view of a conventional transition between a conventional coaxial connector and a microstrip line.
Figure 2A:
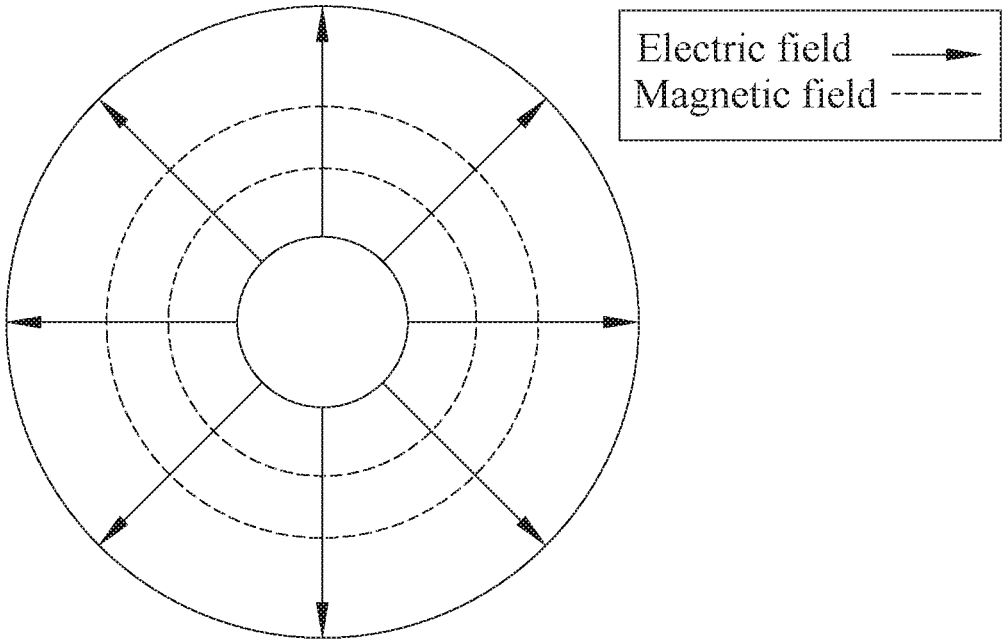
FIG. 2A ( Prior Art )
FIG. 2A is the cross-sectional view of the electromagnetic field distribution within a coaxial structure.
Figure 2B:
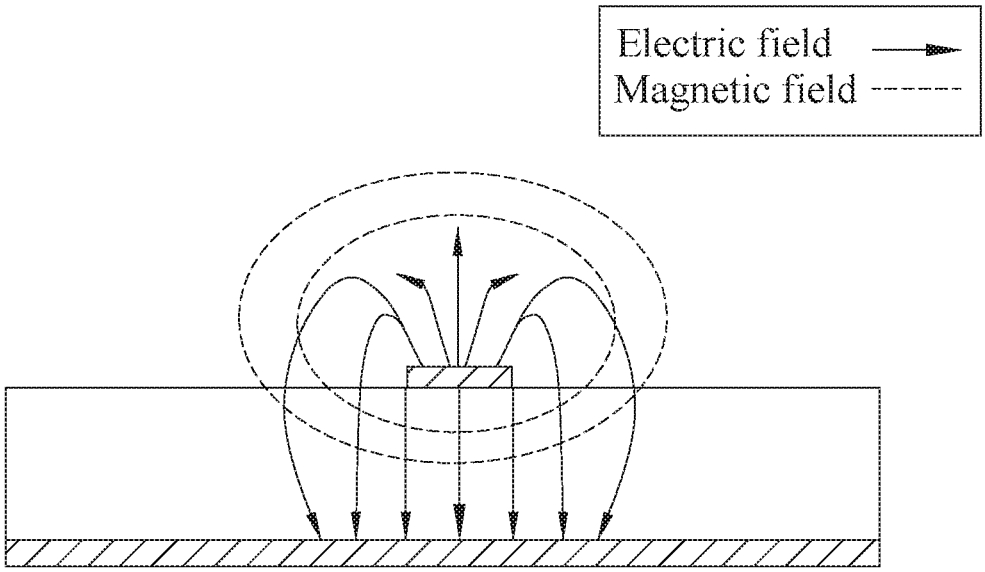
FIG. 2B ( Prior Art )
FIG. 2B is the transverse view of the electromagnetic field distribution of a microstrip line.

Compared to the flange mount coaxial connector 100 shown in FIG. 1, the panel mount coaxial connector 700 here offers the advantages of low cost and compact size. Therefore, the panel mount coaxial connector 700 is often used to replace the flange mounted coaxial connector 100 to establish a transition between a coaxial cable 10 and a microstrip line 200. Since the specifications on the center conductor 710, the external conductor 720, and the dielectric body 740 of the panel mount coaxial connector 700 are exactly the same as the specifications on their corresponding counterparts of the flange mount coaxial connector 100, the frequency response of the transition between the panel mount coaxial connector 700 and the microstrip line 200 would also suffer from the resonant response caused by the excitation of the first higher-order mode of the panel mount coaxial connector 700 accordingly. The solution for the same problem of the transition established by the flange mount coaxial connector 100 can be applied to the problem caused by the panel mount coaxial connector 700 of this exemplary embodiment by introducing a modified metallic ring 300*a* for the panel mount coaxial connector 700 as described earlier to attenuate or even eliminate the resonant response caused by the excitation of the first higher-order mode of the panel mount coaxial connector 700, and therefore to enhance the 1-dB passband of the transition.

FIG. 7 shows the fifth exemplary embodiment of the present invention applied to a vertical transition between the new coaxial connector 400 and a microstrip line 200. The new coaxial connector 400 is exactly the same as the one from the first exemplary embodiment as shown in FIGS. 3A to 3C. However, modifications must be made to the microstrip lines described in the previous exemplary embodiments so that the modified microstrip line is suitable for the application in the vertical transition described in the present exemplary embodiment. Instead of having the signal line 210 of the microstrip line 200 extend longitudinally across the upper surface of the substrate 230, the signal line 210 in this exemplary embodiment only exists at the right side of the transverse dashed line L. A circular through hole 222 with the center $C_1$ thereof is created next to the end of the signal line near the dashed line L as shown in FIG. 7. The leading portion of the center conductor 110 passes through the center $C_2$ of the through hole 320 of the metallic ring 300 from bottom to top, and then through the circular through hole 222. The new coaxial connector 400 is attached to the ground plane 220 of the microstrip line 200, and the end of the center conductor 110 is in contact with the end of the signal line 210 next to the circular through hole 222 after the final assembly so that the new coaxial connector 400 and the microstrip line 200 establish a vertical transition since the center conductor 110 of the new coaxial connector 400 is parallel to the referred Z coordinate while the signal line 210 of the microstrip line 200 is parallel to the referred X coordinate. Noticeably, the signal line 210 of the microstrip line 200 is unable to be inserted into the through hole 320 of the metallic ring 300 under the structure of the vertical transition. In addition, by introducing the coaxial structure constructed by the center conductor 110 of the conventional coaxial connector 100 and the metallic ring 300 with the through hole 320, the resonant response caused by the excitation of the first higher-order mode of the conventional coaxial connector 110 can be attenuated or even eliminated from the frequency response of the vertical transition. Moreover, the center conductor 110 of the conventional coaxial connector 100 and the circular through hole 222 next to the signal line 210 of the microstrip line 200 constitute an eccentric structure. The eccentric stricture serves as a buffer for the change of the electromagnetic field distributions of the two transmission lines at their interface, which ultimately improves the insertion loss of the transition caused by the change of the field distributions, and hence increases the 1-dB passband of the vertical transition.

FIG. 8 shows the frequency response of a horizontal transition from an exemplary embodiment of the present invention in comparison with the frequency responses of two other horizontal transitions designed by different techniques. The "frequency response" in FIG. 8 is defined as the ratio of the signal transmitting through the transition to the signal incident to the transition at different frequency points, which is also called the "$S_{21}$ frequency response". For this exemplary embodiment of the present invention, the conventional coaxial connector thereof is a conventional SMA flange mount coaxial connector. The substrate of the microstrip line has a dielectric constant of 6.15 and a thickness of 0.813 mm. The metallic ring is the same as the one disclosed in the first exemplary embodiment. The frequency responses of the horizontal transitions designed by the three techniques over the frequency range from 1 GHz to 30 GHz are presented for analysis. The conventional transition 1 is established by the conventional SMA flange mount coaxial connector and the same microstrip line, but without the presence of the metallic ring. The 1-dB passband of the conventional transition 1 is 15.87 GHz. The technique for the conventional transition 2 uses a metallic ring to serve as a buffer for the change of the electromagnetic field distributions at the interface between the two transmission lines. The design requires the signal line of the microstrip line inserted into the through hole of the metallic ring and in contact with the center conductor therein. The 1-dB passband of the conventional transition 2 is increased up to 20.50 GHz. However, the design and the assembly thereof are very complicated. The 1-dB passband of the transition of the present invention reaches up to 19.95 GHz, which is increased by 26% as compared to the 1-dB passband of the conventional transition 1. The improvement is prominent at higher frequencies. The 1-dB passband of the transition of the present invention is very close to that of the conventional transition 2. The present invention substantially increases the 1-dB passband of the transition between a coaxial cable and a microstrip line as compared to the traditional technique leading to the conventional transition 1. The present invention also offers the advantages of low in cost and ease in fabrication and assembly to meet the requirements of mass production as compared to the other technique leading to the conventional transition 2.

The present invention is practically proved to be applicable to the transition for a microstrip line with a substrate of different dielectric constant or different thickness, for example, a microstrip line with a substrate of dielectric constant equal to 3.38 or 10.2, or a microstrip line with a substrate of thickness equal to 0.508 mm or 0.305 mm. Moreover, the present invention is also proved to be applicable to the transition for a coplanar waveguide, which is another popular planar transmission line. In addition, the design concept of the present invention can also be applied to the transitions for other varieties of the conventional Teflon-based coaxial connectors. Thus, the present invention is a coaxial connector for the transition between a coaxial cable and a planar transmission line with features of wide applications, low insertion loss for the transition at higher frequencies, and enhancement on the 1-dB passband of the transition.

The foregoing descriptions of the preferred embodiments of the present invention have been presented for the purposes of illustration and explanations. It is not intended to be exclusive or to confine the invention to the precise form or to the disclosed exemplary embodiments. Accordingly, the foregoing descriptions should be regarded as illustrative rather than restrictive. Obviously, many modifications and variations will be apparent to professionals skilled in this art. The embodiments are chosen and described in order to best explain the principles of the invention and its best mode for practical applications, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like is not necessary to confine the scope defined by the claims to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules on the requirement of an abstract for the purpose of conducting survey on patent documents, and should not be used to interpret or limit the scope or meaning of the claims. Any advantages and benefits described hereto may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A method to design and assemble a connector for the transition between a coaxial cable and a microstrip line, comprising the following steps:

providing a metallic ring and a coaxial connector, wherein the metallic ring has a through hole to form an inner wall, and the coaxial connector comprises a center conductor, an external conductor, and a first dielectric body used to fill up a first space between the center conductor and the external conductor, the center conductor of the coaxial connector being coaxially aligned with the through hole of the metallic ring, wherein a second dielectric body which is different from the first dielectric body is used to fill up a second space between the inner wall of the metallic ring and the center conductor;

performing a first calculation formula to relate a plurality of parameters including a characteristic impedance of the coaxial structure, a radius of the center conductor, a radius of the through hole, and a dielectric constant of the second dielectric body, wherein the second dielectric body is air, and performing a second calculation formula to relate a plurality of parameters including a cutoff frequency for the first higher-order mode of the coaxial structure, the radius of the center conductor, the radius of the through hole, and the dielectric constant of the second dielectric body, wherein the first calculation formula is expressed as:

$$Z_0 = \frac{60}{\sqrt{\epsilon_r}} \ln\left(\frac{b}{a}\right)$$

and the second calculation formula is expressed as:

$$f_c = \frac{c\left(\frac{2}{a+b}\right)}{2\pi\sqrt{\epsilon_r}},$$

where:

$Z_0$ denotes the characteristic impedance of the coaxial structure;

$f_c$ denotes the cutoff frequency for the first higher-order mode of the coaxial structure;

$\varepsilon_r$ denotes the dielectric constant of the second dielectric body;

a denotes the radius of the center conductor;

b denotes the radius of the through hole of the metallic ring; and c denotes a constant value of $3\times10^8$ m/s;

calculating a value of the radius of the through hole according to the first calculation formula, and forming the through hole of the metallic ring to the value of the radius of the through hole;

using the value of the radius of the through hole to calculate the cutoff frequency for the first higher-order mode of the coaxial structure according to the second calculation formula;

placing the coaxial connector at a first side of the metallic ring and having the center conductor of the coaxial connector enter the through hole from the first side of the metallic ring via a geometric center of the through hole, and then having a leading portion of the center conductor exit the through hole from a second side of the metallic ring; and establishing a transition structure by placing a microstrip line comprising a signal line, a substrate, and a ground plane next to the second side of the metallic ring, wherein the signal line is connected to the center conductor coming out of the through hole of the metallic ring and is not inserted into the through hole, all of the external conductor of the coaxial connector, the metallic ring, and the ground plane of the microstrip line are electrically connected with one another.

2. The method according to claim 1, wherein the transition structure has a 1-dB passband and a $S_{11}$ frequency response, the metallic ring has a thickness, the method further comprising:

selecting a designed thickness for the metallic ring based on a first relationship between the 1-dB passband of the transition structure and the thickness of the metallic ring, as well as a second relationship between the $S_{11}$ frequency response of the transition structure and the thickness of the metallic ring, and forming the metallic ring to the designed thickness.

3. The method according to claim 2, further comprising:

having the center conductor of the coaxial connector pass through the through hole of the metallic ring via the geometric center of the through hole, subsequently connecting the center conductor coming out of the through hole to the signal line of the microstrip line horizontally to establish a horizontal transition.

4. The method according to claim 2, wherein the characteristic impedance of the coaxial structure is 50 ohm, the radius of the through hole is 1.46 mm, the thickness of the metallic ring is 1.5 mm, and the cutoff frequency for the first higher-order mode of the coaxial structure is 45.6 GHz.

5. The method according to claim 1, further comprising:

placing the microstrip line in a metallic box comprising four metallic walls, a base, and a top cover;

creating a circular through hole in one of the metallic walls, wherein the circular through hole has a designed radius calculated by the first calculation formula with the predetermined value for the characteristic impedance, wherein the metallic wall with the circular through hole serves as the metallic ring with the through hole; and having the center conductor of the coaxial connector enter the metallic box from the outside of the metallic box via the geometric center of the circular through hole in the metallic wall, subsequently connecting the center conductor inside the metallic box to the signal line of the microstrip line to establish a transition.

6. The method according to claim 1, further comprising:

having the center conductor of the coaxial connector pass through the through hole of the metallic ring from bottom to top via the geometric center of the through hole, subsequently connecting the center conductor coming out of the through hole to the signal line of the microstrip line vertically to establish a vertical transition.

7. The method according to claim 1, wherein an inner diameter of the through hole of the metallic ring, which is calculated on the basis of the first calculation formula, is less than an inner diameter of the external conductor of the coaxial connector.

8. The method according to claim 1, wherein the coaxial connector is a panel mount coaxial connector including a mounting wall with a plurality of mounting pedestals, and the method comprising the following steps:

creating a plurality of notches around the edge of the metallic ring to form a modified metallic ring, wherein each of the notches is made for the corresponding mounting pedestal to pass through the modified metallic ring; and having the center conductor of the coaxial connector pass through the through hole of the modified metallic ring via the geometric center of the through hole, and then having the leading portion of the center conductor exit the through hole from the second side of the modified metallic ring, and also having each of the mounting pedestals pass through the modified metallic ring via its corresponding notch, accordingly.

* * * * *